US010726704B1

(12) United States Patent
Kern et al.

(10) Patent No.: US 10,726,704 B1
(45) Date of Patent: Jul. 28, 2020

(54) SYSTEMS AND METHODS FOR DELAYING TRANSMISSION OF AN ALARM SIGNAL TO A CENTRAL MONITORING STATION IN RESPONSE TO DETECTING DELAY ACTIONS

(71) Applicant: Ademco Inc., Golden Valley, MN (US)

(72) Inventors: James Kern, East Islip, NY (US); Christopher Coleman, Centereach, NY (US); Philip Ferro, Setauket, NY (US)

(73) Assignee: ADEMCO INC., Golden Valley, MN (US)

( * ) Notice: Subject to any disclaimer, the term of this patent is extended or adjusted under 35 U.S.C. 154(b) by 0 days.

(21) Appl. No.: 16/460,591

(22) Filed: Jul. 2, 2019

(51) Int. Cl.
*G08B 25/00* (2006.01)
*G08B 25/01* (2006.01)
*G08B 25/10* (2006.01)

(52) U.S. Cl.
CPC ..... *G08B 25/001* (2013.01); *G08B 25/014* (2013.01); *G08B 25/10* (2013.01)

(58) Field of Classification Search
CPC ..... G08B 25/001; G08B 25/014; G08B 25/10
USPC ..... 340/505
See application file for complete search history.

(56) References Cited

U.S. PATENT DOCUMENTS

| | | | | |
|---|---|---|---|---|
| 7,054,414 | B2 | 5/2006 | Bergman et al. | |
| 8,274,385 | B2 | 9/2012 | Meier et al. | |
| 9,842,485 | B2 | 12/2017 | Scaria et al. | |
| 2012/0084857 | A1* | 4/2012 | Hubner | G08B 25/001 726/22 |
| 2015/0029020 | A1* | 1/2015 | Bailey | G08B 25/001 340/502 |
| 2017/0061776 | A1* | 3/2017 | Scaria | G08B 21/025 |

* cited by examiner

*Primary Examiner* — Joseph H Feild
*Assistant Examiner* — Sharmin Akhter
(74) *Attorney, Agent, or Firm* — Husch Blackwell LLP

(57) ABSTRACT

Systems and methods for delaying transmission of an alarm signal responsive to detecting delay actions indicative of progress towards confirming or denying the alarm signal are provided and can include an alarm processing device receiving the alarm signal and determining whether a user device is enrolled in an alarm notification service. When the user device is enrolled in the alarm notification service, the alarm processing device can transmit a notification to the user device, start a delay timer, and determine whether a first delay action associated with the user device is detected prior to expiration of the delay timer. When the first delay action is detected prior to the expiration of the delay timer, the alarm processing device can alter the delay timer consistent with a next delay action associated with the user device and, when the delay timer expires, transmit the alarm signal to the central monitoring station.

12 Claims, 2 Drawing Sheets

SYSTEMS AND METHODS FOR DELAYING TRANSMISSION OF AN ALARM SIGNAL TO A CENTRAL MONITORING STATION IN RESPONSE TO DETECTING DELAY ACTIONS

FIELD

The present invention relates generally to security systems. More particularly, the present invention relates to systems and methods for delaying transmission of an alarm signal to a central monitoring station in response to detecting delay actions.

BACKGROUND

Known security systems often produce false alarms. To prevent transmission of such false alarms to relevant authorities, a live operator at a central monitoring station may attempt to verify an alarm signal from a security system by contacting an owner or a user of the security system prior to transmitting the alarm signal to the relevant authorities. However, such a process is expensive in terms of both time and manpower.

Known security systems can also include a web interface or a mobile application on a user device of the owner to facilitate the owner remotely monitoring the security system and conditions thereof. However, known security systems do not rely on the owner using the mobile application to confirm the alarm signal before transmitting the alarm signal to the central monitoring station because doing so could substantially delay the transmission of the alarm signal, thereby undermining a principle function of security systems: early notification of alarm conditions. Accordingly, upon receipt of the alarm signal, the operator at the central monitoring station must still attempt to verify the alarm signal in a manner as described above before contacting the relevant authorities.

In view of the above, there is a need and an opportunity for improved systems and methods.

DETAILED DESCRIPTION

Figure 1:
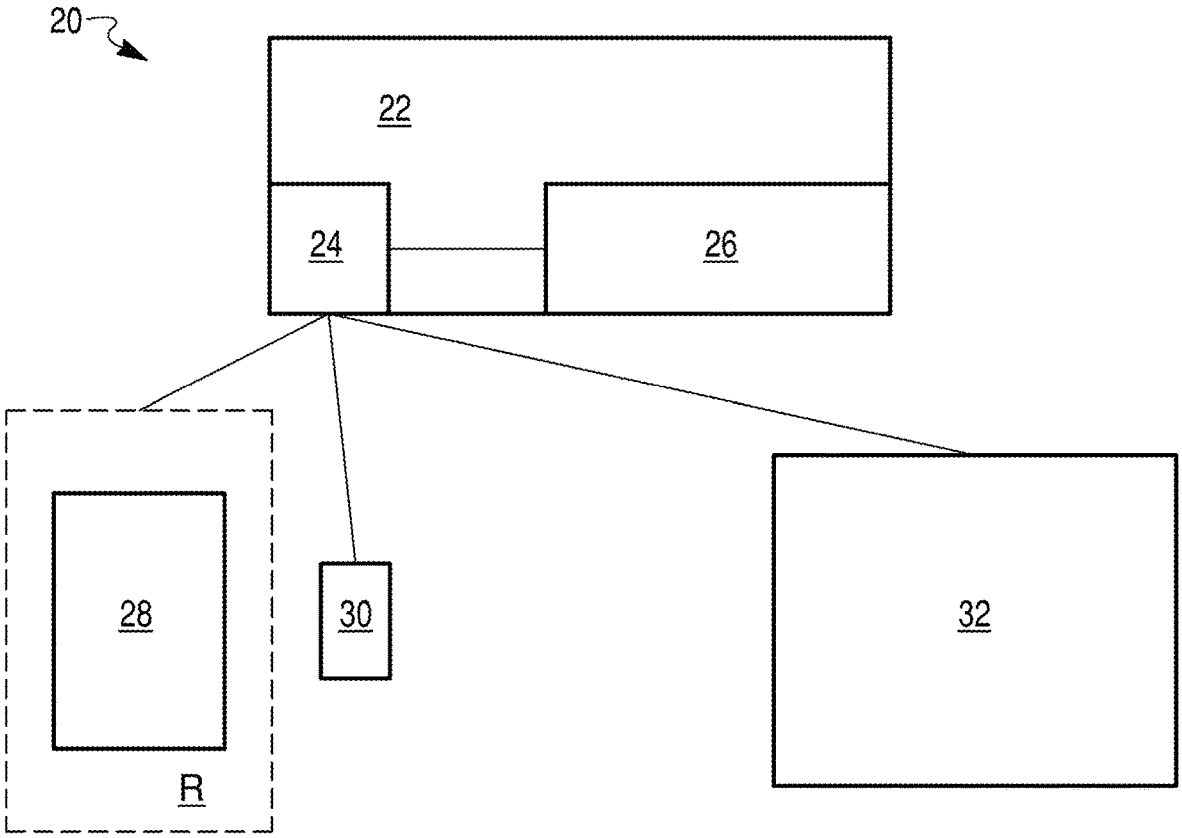
FIG. 1 is a block diagram of a system in accordance with disclosed embodiments.

While this invention is susceptible of an embodiment in many different forms, specific embodiments thereof will be described herein in detail with the understanding that the present disclosure is to be considered as an exemplification of the principles of the invention. It is not intended to limit the invention to the specific illustrated embodiments.

Embodiments disclosed herein can include systems and methods for delaying transmission of an alarm signal to a central monitoring station in response to detecting delay actions. Detecting the delay actions can indicate that progress is being made towards confirming or denying the alarm signal and that user input confirming or denying the alarm signal is likely to be received within a predetermined period of time. Therefore, systems and methods disclosed herein can ensure that the alarm signal is transmitted to the central monitoring station in a timely manner while delaying the transmission of the alarm signal to allow for time to obtain the user input confirming or denying the alarm signal only when such user input is likely to be received. In this manner, when compared to systems and methods that do not make any attempt to solicit the user input confirming or denying the alarm signal prior to transmitting the alarm signal to the central monitoring station, systems and methods disclosed herein can reduce the transmission of false alarms to the central monitoring station and minimize a required user response at the central monitoring station when the alarm signal is transmitted thereto.

In accordance with disclosed embodiments, an alarm processing device in communication with a security system that monitors a secured region can receive the alarm signal from the security system and determine whether the delay actions are detected. The delay actions can include any action that indicates that progress is being made towards confirming or denying the alarm signal, for example, confirmation that a user device associated with the secured region has received a notification of the alarm signal and/or confirmation that a mobile application associated with an alarm notification service has been opened on the user device. In response to detecting a delay action, the transmission of the alarm signal to the central monitoring station can be delayed in a manner that can be dependent on, among other things, user response and input defining the delay actions and the delay actions detected. In some embodiments, the alarm processing device can be a part of a cloud server coupled to a control panel device of the security system or can be the cloud server itself. However, in some embodiments, the alarm processing device can be a part of the control panel device or can be the control panel device itself.

For example, in some embodiments, when the alarm processing device receives the alarm signal from the security system, the alarm processing device can determine whether the user device or a user associated with the secured region is enrolled in the alarm notification service. When the user device is not enrolled in the alarm notification service, the alarm processing device can transmit the alarm signal to the central monitoring station without any delay. However, when the user device is enrolled in the alarm notification service, the alarm processing device can transmit the notification of the alarm signal to the user device and start a delay timer. In some embodiments, the alarm notification service can define a communication medium and a format for transmitting the notification of the alarm signal to the user device, and in some embodiments, the communication medium and the format can be saved in a database of the alarm processing device.

Furthermore, in some embodiments, the alarm processing device can alter the delay timer responsive to detecting any of the delay actions in connection with the user device and transmit the alarm signal to the central monitoring station when the delay timer expires. In some embodiments, the delay actions can be associated with the user device and, as explained above, include, for example, the user device receiving the notification of the alarm signal from the alarm processing device, the user device opening the mobile application on the user device, the user device receiving the user input confirming or denying the alarm signal, and the like.

For example, after transmitting the notification of the alarm signal to the user device and starting the delay timer, the alarm processing device can determine whether a first of the delay actions is detected prior to expiration of the delay timer. When the first of the delay actions is detected prior to the expiration of the delay timer, the alarm processing device can alter the delay timer consistent with a next of the delay actions. Similarly, after altering the delay timer consistent with the next of the delay actions, the alarm processing device can determine whether the next of the delay actions is detected prior to the expiration of the delay timer and, when the next of the delay actions is detected prior to the expiration of the delay timer, alter the delay timer consistent with a further of the delay actions. In some embodiments, after detecting a penultimate one of the delay actions prior to the expiration of the delay timer, the alarm processing device can alter the delay timer consistent with a final one of the delay actions, but cease determining whether any of the delay actions is detected and altering the delay timer thereafter.

In some embodiments, systems and methods disclosed herein can receive user input identifying a maximum delay time allowed after the alarm processing device receives the alarm signal, and the alarm processing device can monitor the maximum delay time separately from the delay timer. In such embodiments, when the maximum delay time expires, the alarm processing device can transmit the alarm signal to the central monitoring station irrespective of the delay timer and any of the delay actions detected. In this manner, systems and methods disclosed herein can ensure that the alarm signal is transmitted to the central monitoring station in a timeframe that does not exceed the maximum delay time, regardless of any other circumstances.

As explained above, the delay actions can be associated with and detected in connection with the user device. For example, in some embodiments, the first of the delay actions can include the user device successfully receiving the notification of the alarm signal, the next of the delay actions can include the user device opening the mobile application associated with the alarm notification service on the user device, and the further of the delay actions can include the user device receiving the user input confirming or denying the alarm signal. As such, the alarm processing device can receive notifications from the user device or otherwise detect when each of the delay actions occurs.

It is to be understood that a number of the delay actions is not limited to three and could be more or less than three as would be known and desired to indicate that the progress is being made towards confirming or denying the alarm signal and that the user input confirming or denying the alarm signal is likely to be received prior to the expiration of the delay timer. It is also to be understood that additional or alternative delay actions are contemplated and can include, but are not limited to user input manually adjusting the delay timer and user input activating a camera view or video playback to view the secured region for use in confirming or denying the alarm signal.

In some embodiments, when the alarm processing device and/or the user device receive the user input confirming the alarm signal prior to the expiration of the delay timer, the alarm processing device can transmit the alarm signal to the central monitoring station with a notification confirming the alarm signal. Responsive thereto, the central monitoring station can bypass known verification procedures and alert the relevant authorities about the alarm signal without soliciting any user feedback regarding the alarm signal. However, when the alarm processing device and/or the user device receive the user input denying the alarm signal prior to the expiration of the delay timer, the alarm processing device can terminate the delay timer and refrain from transmitting the alarm signal to the central monitoring station, thereby avoiding the transmission of a false alarm to the central monitoring station.

In some embodiments, the alarm processing device and/or the user device can receive the user input confirming or denying the alarm signal via a user interface that includes a cancel button and a transmit alarm button. In such embodiments, the user input denying the alarm signal can include activation of the cancel button to override any delays, and the user input confirming the alarm signal can include activation of the transmit alarm button to override any outstanding delays.

Various methods for starting and altering the delay timer are contemplated. For example, in some embodiments, starting the delay timer and altering the delay timer can include incrementing the delay timer by a micro delay amount that is independent of the delay actions and that is equal for each of the delay actions. In these embodiments, the micro delay amount can be predetermined, or systems and methods disclosed herein can receive user input identifying the micro delay amount. Similarly, in some embodiments, altering the delay timer can include restarting the delay timer independently of which of the delay actions is expected to be detected next.

However, in some embodiments, starting the delay timer and altering the delay timer can be dependent on an expected one of the delay actions to be detected next. For example, in such embodiments, starting the delay timer can include starting the delay timer with a first delay amount associated with the first of the delay actions, and altering the delay timer consistent with the next of the delay actions can include incrementing the delay timer by a next delay amount associated with the next of the delay actions or resetting the delay timer with the next delay amount. Alternatively, in such embodiments, the delay timer can include a sequence of timers, wherein each of the timers can be associated with a respective one of the delay action and monitor a respective delay amount. In some embodiments, the first delay amount can include a first expected time from starting the delay timer to an occurrence of the first of the delay actions, and the next delay amount can include a second expected time from the occurrence of the first of the delay actions to an occurrence of the next of the delay actions. Furthermore, in some embodiments, responsive to determining that the user device is enrolled in the alarm notification service, the alarm processing device can retrieve the first delay amount from the database of the alarm processing device and, responsive to detecting the first of the delay actions prior to the expiration of the delay timer, retrieve the next delay amount from the database.

FIG. 1 is a block diagram of a system 20 in accordance with disclosed embodiments. As seen in FIG. 1, the system 20 can include an alarm processing device 22, a security system 28 monitoring a secured region R, a user device 30 associated with the secured region R or a user of the secured region R, and a central monitoring station 32. In some embodiments, the alarm processing device 22 can include a transceiver device 24 and a programmable processor 26, and in some embodiments, the alarm processing device 22 can be or be part of a cloud server remote from the secured region R or a control panel device of the security system 28.

Figure 2:
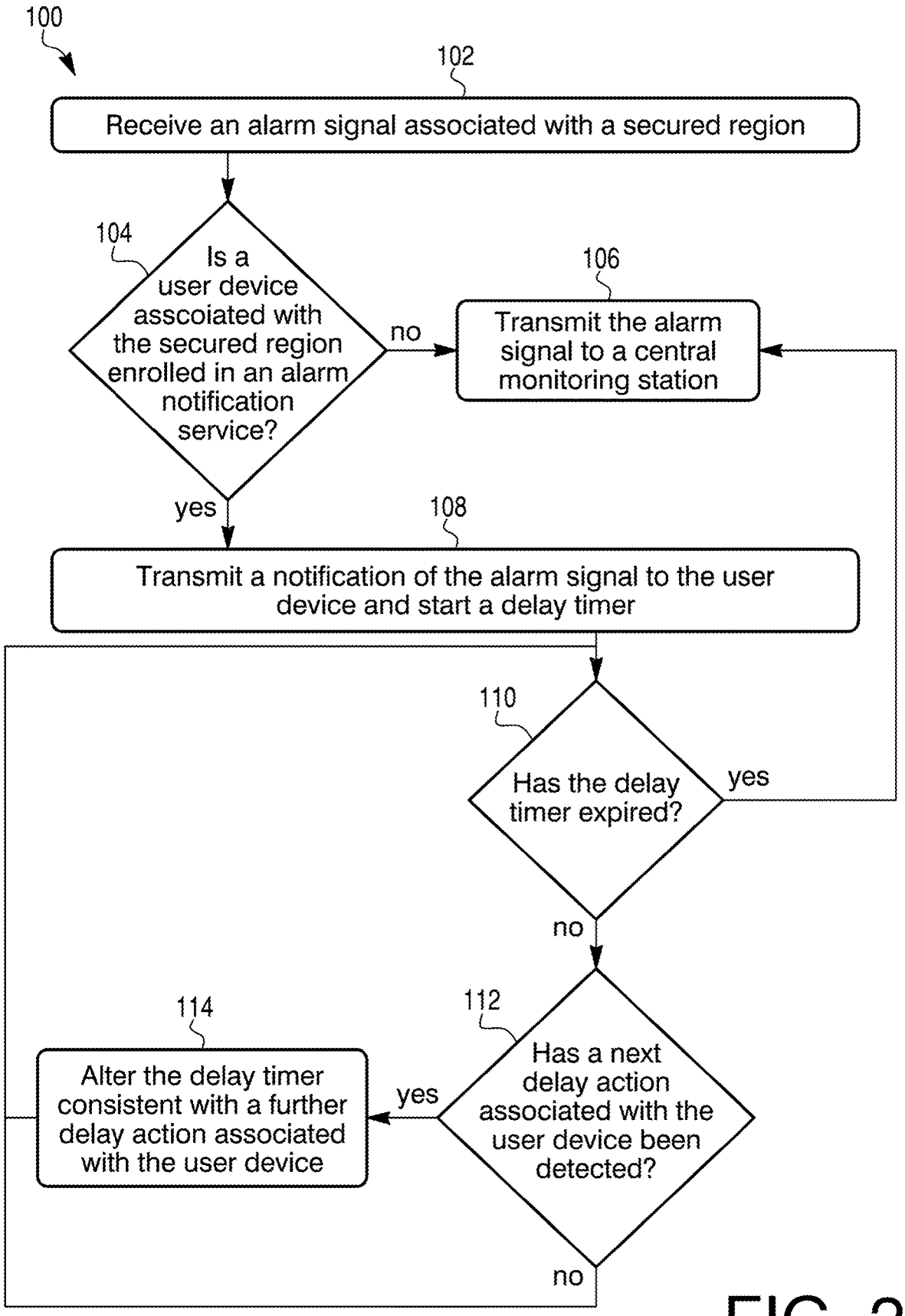
FIG. 2 is a flow diagram of a method in accordance with disclosed embodiments.

FIG. 2 is a flow diagram of a method 100 in accordance with disclosed embodiments. As seen in FIG. 2, the method 100 can include the transceiver device 24 receiving an alarm signal associated with the secured region R, as in 102, and the programmable processor 26 determining whether the user device 30 is enrolled in an alarm notification service, as in 104. When the user device 30 is not enrolled in the alarm notification service, the method 100 can include the transceiver device 24 transmitting the alarm signal to the central monitoring station 32, as in 106.

However, when the user device 30 is enrolled in the alarm notification service, the method 100 can include the transceiver device 24 transmitting a notification of the alarm signal to the user device 30 and the programmable processor 26 starting a delay timer, as in 108. Then, the method 100 can include the programmable processor 26 determining whether the delay timer has expired, as in 110. When the delay timer has expired, the method 100 can include the transceiver device 24 transmitting the alarm signal to the central monitoring station 32, as in 106. However, when the delay timer has not expired, the method 100 can include the programmable processor 26 determining whether a next delay action associated with the user device 30 has been detected, as in 112. If not, then the method 100 can include the programmable processor 26 determining whether the delay timer has expired, as in 110. However, when the next delay action has been detected, the method 100 can include the programmable processor 26 altering the delay timer consistent with a further delay action, as in 114. Then, the method can continue determining whether the delay timer has expired as, in 110.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A method comprising:

receiving an alarm signal associated with a secured region;

responsive to receiving the alarm signal, determining whether a user device associated with the secured region is enrolled in an alarm notification service;

when the user device is not enrolled in the alarm notification service, transmitting the alarm signal to a central monitoring station;

when the user device is enrolled in the alarm notification service, transmitting a first notification of the alarm signal to the user device and starting a delay timer;

determining whether a first delay action associated with the user device is detected prior to expiration of the delay timer;

when the first delay action is detected prior to the expiration of the delay timer, altering the delay timer consistent with a next delay action associated with the user device; and when the delay timer expires, transmitting the alarm signal to the central monitoring station, wherein starting the delay timer and altering the delay timer include incrementing the delay timer by a micro delay amount.

2. The method of claim 1 further comprising:

when user input confirming the alarm signal is received prior to the expiration of the delay timer, transmitting the alarm signal to the central monitoring station with a second notification that the alarm signal is confirmed; and when user input denying the alarm signal is received prior to the expiration of the delay timer, terminating the delay timer and refraining from transmitting the alarm signal to the central monitoring station.

3. The method of claim 1 further comprising:

determining whether the next delay action is detected prior to the expiration of the delay timer; and when the next delay action is detected prior to the expiration of the delay timer, altering the delay timer consistent with a further delay action.

4. The method of claim 3 wherein the first delay action includes the user device successfully receiving the first notification, wherein the next delay action includes the user device opening a mobile application associated with the alarm notification service on the user device, and wherein the further delay action includes the user device receiving user input confirming the alarm signal or user input denying the alarm signal.

5. The method of claim 1 further comprising:

receiving the alarm signal at a cloud server from a control panel of a security system that monitors the secured region, wherein the cloud server is remote from the secured region.

6. A system comprising:

a programmable processor; and a transceiver device, wherein the transceiver device receives an alarm signal associated with a secured region, wherein, responsive to the transceiver device receiving the alarm signal, the programmable processor determines whether a user device associated with the secured region is enrolled in an alarm notification service, wherein, when the user device is not enrolled in the alarm notification service, the transceiver device transmits the alarm signal to a central monitoring station, wherein, when the user device is enrolled in the alarm notification service, the transceiver device transmits a first notification of the alarm signal to the user device and the programmable processor starts a delay timer, wherein the programmable processor determines whether a first delay action associated with the user device is detected prior to expiration of the delay timer, wherein, when the first delay action is detected prior to the expiration of the delay timer, the programmable processor alters the delay timer consistent with a next delay action associated with the user device, wherein, when the delay timer expires, the transceiver device transmits the alarm signal to the central monitoring station, and wherein the programmable processor starting the delay timer and altering the delay timer includes the programmable processor incrementing the delay timer by a micro delay amount.

7. The system of claim 6 wherein, when the transceiver device receives user input confirming the alarm signal prior to the expiration of the delay timer, the transceiver device transmits the alarm signal to the central monitoring station with a second notification that the alarm signal is confirmed, and wherein, when the transceiver device receives user input denying the alarm signal prior to the expiration of the delay timer, the programmable processor terminates the delay timer and the transceiver device refrains from transmitting the alarm signal to the central monitoring station.

8. The system of claim 6 wherein the programmable processor determines whether the next delay action is detected prior to the expiration of the delay timer, and wherein, when the next delay action is detected prior to the expiration of the delay timer, the programmable processor alters the delay timer consistent with a further delay action.

9. The system of claim 6 wherein the transceiver device and the programmable processor are part of a cloud server remote from the secured region.

10. A system comprising:

a programmable processor; and a transceiver device, wherein the transceiver device receives an alarm signal associated with a secured region, wherein, responsive to the transceiver device receiving the alarm signal, the programmable processor determines whether a user device associated with the secured region is enrolled in an alarm notification service, wherein, when the user device is not enrolled in the alarm notification service, the transceiver device transmits the alarm signal to a central monitoring station, wherein, when the user device is enrolled in the alarm notification service, the transceiver device transmits a first notification of the alarm signal to the user device and the programmable processor starts a delay timer, wherein the programmable processor determines whether a first delay action associated with the user device is detected prior to expiration of the delay timer, wherein, when the first delay action is detected prior to the expiration of the delay timer, the programmable processor alters the delay timer consistent with a next delay action associated with the user device, wherein, when the delay timer expires, the transceiver device transmits the alarm signal to the central monitoring station, wherein the programmable processor determines whether the next delay action is detected prior to the expiration of the delay timer, wherein, when the next delay action is detected prior to the expiration of the delay timer, the programmable processor alters the delay timer consistent with a further delay action, wherein the first delay action includes the user device successfully receiving the first notification, wherein the next delay action includes the user device opening a mobile application associated with the alarm notification service on the user device, and wherein the further delay action includes the user device receiving user input confirming the alarm signal or user input denying the alarm signal.

11. A system comprising:

a programmable processor; and a transceiver device, wherein the transceiver device receives an alarm signal associated with a secured region, wherein, responsive to the transceiver device receiving the alarm signal, the programmable processor determines whether a user device associated with the secured region is enrolled in an alarm notification service, wherein, when the user device is not enrolled in the alarm notification service, the transceiver device transmits the alarm signal to a central monitoring station, wherein, when the user device is enrolled in the alarm notification service, the transceiver device transmits a first notification of the alarm signal to the user device and the programmable processor starts a delay timer, wherein the programmable processor determines whether a first delay action associated with the user device is detected prior to expiration of the delay timer, wherein, when the first delay action is detected prior to the expiration of the delay timer, the programmable processor alters the delay timer consistent with a next delay action associated with the user device, wherein, when the delay timer expires, the transceiver device transmits the alarm signal to the central monitoring station, wherein the programmable processor starting the delay timer includes the programmable processor starting the delay timer with a first delay amount associated with the first delay action, wherein the programmable processor altering the delay timer consistent with the next delay action includes the programmable processor incrementing the delay timer by a next delay amount associated with the next delay action, wherein, responsive to determining that the user device is enrolled in the alarm notification service, the programmable processor retrieves the first delay amount from a database device, and wherein, responsive to detecting the first delay action prior to the expiration of the delay timer, the programmable processor retrieves the next delay amount from the database device.

12. The system of claim 11 wherein the first delay amount is a first expected time from starting the delay timer to an occurrence of the first delay action, and wherein the next delay amount is a second expected time from the occurrence of the first delay action to an occurrence of the next delay action.

* * * * *